United States Patent [19]

Barnes

[11] 3,945,443

[45] Mar. 23, 1976

[54] STEERABLE ROCK BORING HEAD FOR EARTH BORING MACHINES

[75] Inventor: Thomas W. Barnes, Franklin, Ohio

[73] Assignee: The Richmond Manufacturing Company, Ashland, Ohio

[22] Filed: Aug. 14, 1974

[21] Appl. No.: 497,245

[52] U.S. Cl. ..... 175/73; 175/61; 175/62; 175/122; 175/173

[51] Int. Cl.[2] ..... E21B 7/08

[58] Field of Search ..... 175/45, 61, 62, 122, 73–76, 175/162, 103, 203, 230, 171, 173

[56] References Cited

UNITED STATES PATENTS

| | | | |
|---|---|---|---|
| 2,165,666 | 7/1939 | Tilly | 175/122 |
| 3,326,008 | 6/1967 | Baran et al. | 175/73 X |
| 3,354,969 | 11/1967 | Ebeling | 175/103 X |
| 3,415,329 | 12/1968 | Mårlind | 175/73 X |
| 3,526,285 | 9/1970 | Adkins et al. | 175/73 |
| 3,743,034 | 7/1973 | Bradley | 175/73 X |
| 3,767,836 | 10/1973 | Geis et al. | 175/61 X |
| 3,797,589 | 3/1974 | Kellner et al. | 175/230 X |
| 3,848,685 | 11/1974 | Takagi et al. | 175/103 X |

*Primary Examiner*—David H. Brown
*Attorney, Agent, or Firm*—Palmer Fultz

[57] ABSTRACT

A portable earth boring machine for the horizontal boring of shafts and the insertion of pipeline casing sections in installations where excavation from the surface is undesirable. The machine is characterized by a steering head particularly adapted for rock drilling operations which head is positioned at the front of the casings and remotely controlled by the machine operator so as to directionally control the direction of extension of the pipeline as the drilling operation progresses.

6 Claims, 6 Drawing Figures

STEERABLE ROCK BORING HEAD FOR EARTH BORING MACHINES

BACKGROUND OF THE INVENTION

This invention relates to portable earth boring machines and more particularly to a machine adapted for horizontal boring of shafts for the insertion of pipelines at installations where excavation from the surface is undesirable.

SUMMARY OF THE INVENTION

In general, the machine of the present invention comprises a base means that includes spaced track members which are disposed in a trench adjacent to the hill to be bored. The machine further includes a frame means mounted for movement along the track means and such carriage supports a power train for rotating connected sections of auger shafts which comprise a progressively extendable boring auger. The frame means further supports a pusher ring for driving sections of casings into the bored hole and an associated pushing cylinder means is provided for advancing and retracting the frame means and pusher ring along the track means.

In accordance with the present invention the earth boring machine is provided with a novel adjustable steering head which in general comprises a plurality of wedging means which are mounted in circumferentially spaced relationship on the front casing section with the wedging means being selectively extendable and retractable laterally outwardly against the rock surface. In the preferred embodiment the steering head is provided with remote control apparatus for varying the direction and magnitude of the wedging force applied by the wedging means so as to directionally control the path of the pipeline as the boring operation progresses.

As another aspect of the present invention the adjustable steering head is easily fabricated by modifying a standard casing section so as to include a bearing support for the rock boring head as well as the above mentioned steering apparatus.

It is therefore an object of the present invention to provide novel steering head means for controlling the establishment of grade in the boring of pipeline holes in rock formations.

It is another object of the present invention to provide an apparatus of the type described that includes novel remote control apparatus for the steering head.

Further objects and advantages of the present invention will be apparent from the following description, reference being had to the accompanying drawings wherein a preferred form of embodiment of the invention is clearly shown.

DESCRIPTION OF PREFERRED EMBODIMENTS

Figure 1:
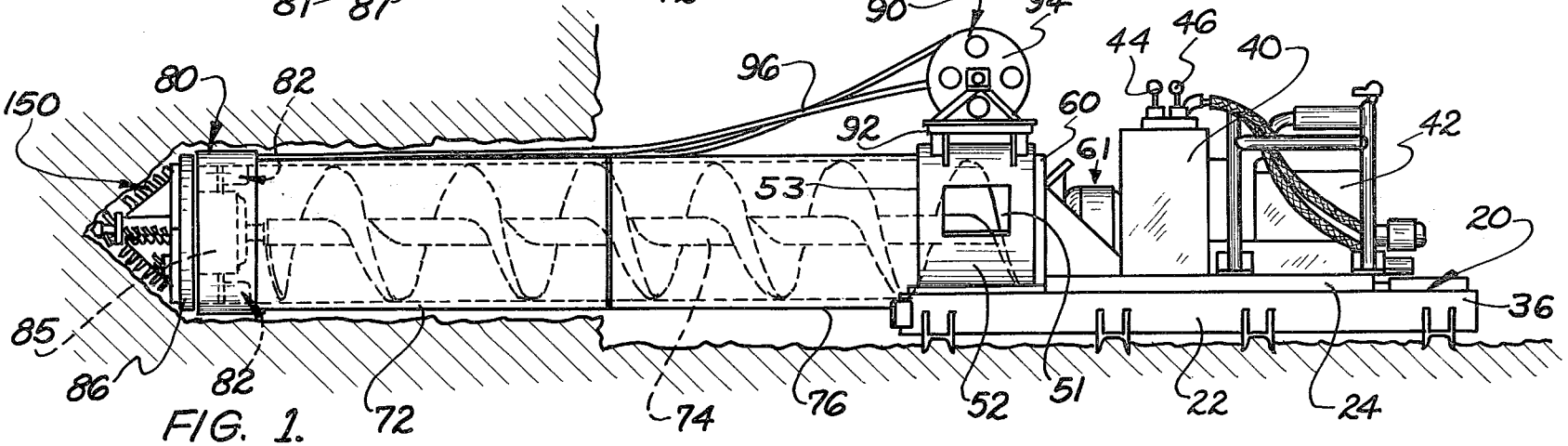
FIG. 1 is a side elevational view of a boring machine constructed in accordance with the present invention.

Referring in detail to the drawings, FIG. 1 illustrates the complete horizontal earth boring machine of the present invention which comprises a base means indicated generally at 20. Such base means includes spaced longitudinally extending track means 22 which support a carriage means indicated generally at 24.

The carriage means 24 is advanced and retracted along track 22 by a pair of hydraulic pushing cylinders, with such pushing cylinders being operatively connected between a power cylinder base 36 and the carriage means 24.

Details of typical power cylinders, not illustrated and power cylinder base 36 are disclosed and described in detail in the application of Albert R. Richmond, Ser. No. 867,816 filed Oct. 20, 1969, now U.S. Pat. No. 3,612,195 issued Nov. 12, 1971.

It will be further seen that pressurized fluid for actuating the power cylinders is provided by a fluid power system, FIG. 6, including a pump 210 driven by an engine 42, FIG. 1 with such system being described in detail later herein. The fluid power circuit further includes control valve actuators 44 and 46 which are manually actuated to extend and retract the pushing cylinders to move carriage 24 forwardly or rearwardly along the track means 22.

Referring again to FIG. 1, the boring machine further includes a pusher ring 52 including a front annular surface 53 for engaging the sections of pipe casing for pushing such sections into the bored hole. Such pusher ring 52 includes a thrust plate means 60 mounted on the carriage means for absorbing the pushing thrust and boring thrust of the auger assembly 74. A hydraulic drive assembly 61 is interposed between engine 42 and auger assembly 74, such hydraulic drive arrangement being described in co-pending application Ser. No. 337,211, filed Mar. 1, 1973, now U.S. Pat. No. 3,870,110.

A typical auger construction for connection with the machine of the present invention is disclosed and described in detail in the application of Albert R. Richmond, Ser. No. 85,614 filed Oct. 30, 1970 now U.S. Pat. No. 3,693,734 issued Sept. 26, 1972.

Figure 2:
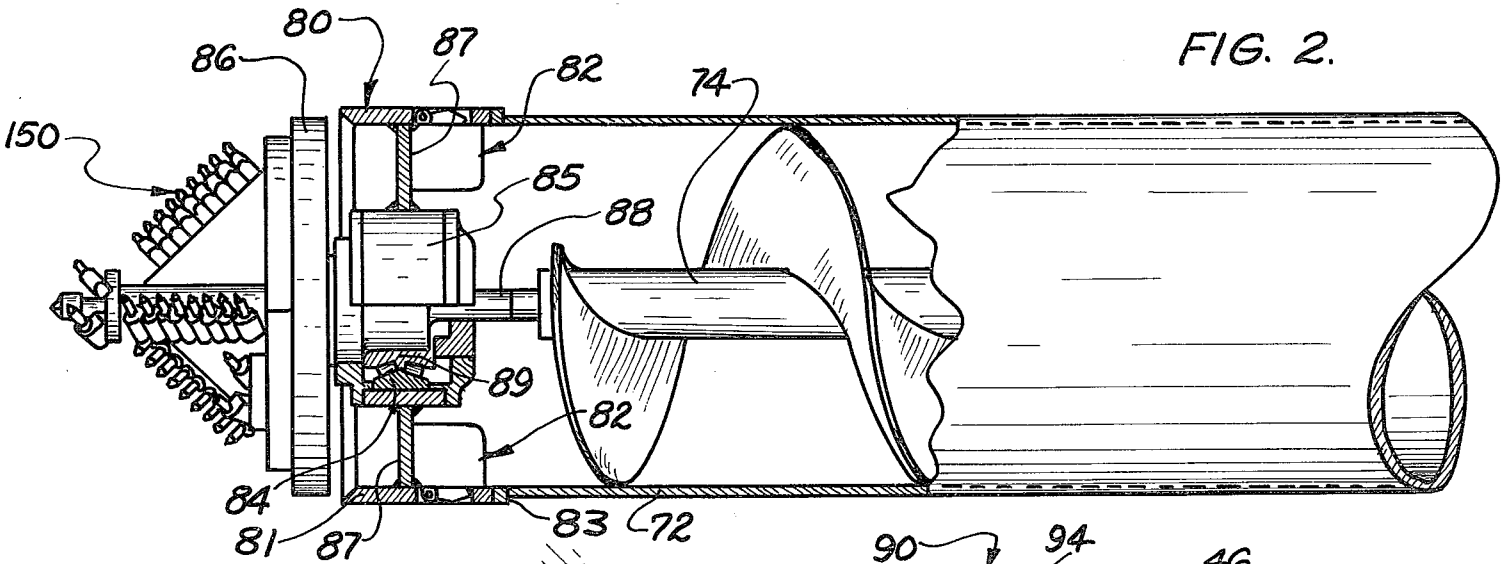
FIG. 2 is a partial side elevational view of a steering head comprising a portion of the apparatus of FIG. 1.

Reference is next made to the steering head apparatus of the present invention with the remote control embodiment being shown installed on the machine of FIG. 1 and illustrated in enlarged detail in FIGS. 2, 3, 5 and 6. The steering head apparatus is indicated generally at 80 and is installed on a modified standard front casing section 72 and includes a heavy duty housing ring 81 of heavy tubular steel material which is joined to the front end of the casing section at a weld 83 as best seen in FIG. 2.

A plurality of radially extending spaced legs 87 rigidly support a central bearing means 85, the latter including a housing that contains a tapered roller bearing assembly 89. Such bearing means rotatably supports a rock head mounting shaft 88 including a front head mounting plate 86 on which is removably mounted a rock bit indicated generally at 150 with a typical rock bit being disclosed and described in detail in U.S. Pat. No. 3,693,734.

As seen in FIG. 2 rock head mounting shaft 88 is removably joined to a front auger section at a male and female joint of hexagonal cross-sectional shape.

Figure 3:
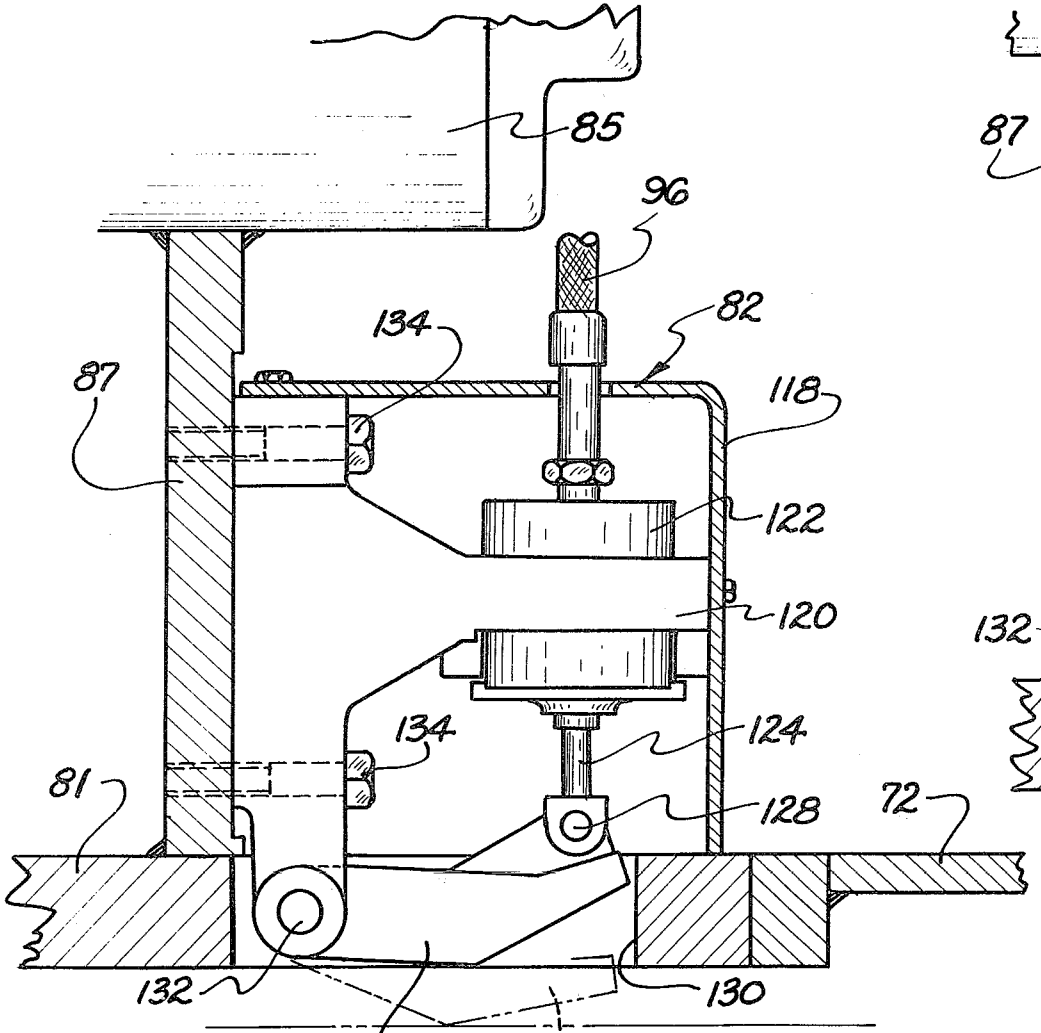
FIG. 3 is a side elevational view, partially in section, of a wedging means comprising a portion of the apparatus of FIGS. 1 and 2.

With particular reference to FIGS. 2 and 3, the above mentioned steering head 80 comprises a plurality of circumferentially spaced wedging means indicated generally at 82 with four of such wedging means being utilized in the preferred embodiment and spaced at 90° intervals around the inner surface of the rock head housing ring 81.

Referring particularly to FIG. 3, one of the wedging apparatus is illustrated in enlarged detail and includes a bracket 120 mounted on a respective radial leg 87 by cap screws 134. Such bracket supports a hydraulic cylinder 122, which is shown as a single acting type including a return spring 198, FIG. 6, with such cylinder being fed with and exhausted of pressurized fluid via a flexible hydraulic line 96 which is extended back along the outer surfaces of the casing sections such as 72 and 76.

Each of the power cylinders includes a ram 124 which is pivotally attached to a wedging element 126 at a pivot pin 128, with such wedging element being in turn pivotally mounted to the previously mentioned bracket 120 at a wedge mounting pivot 132.

It will be noted from FIG. 3 that wedging element 126 is disposed in an opening 130 provided in housing ring 81 so as to be extendable and retractable outwardly and inwardly to engage and apply force to the surrounding rock surface of the hole being drilled.

Figure 5:
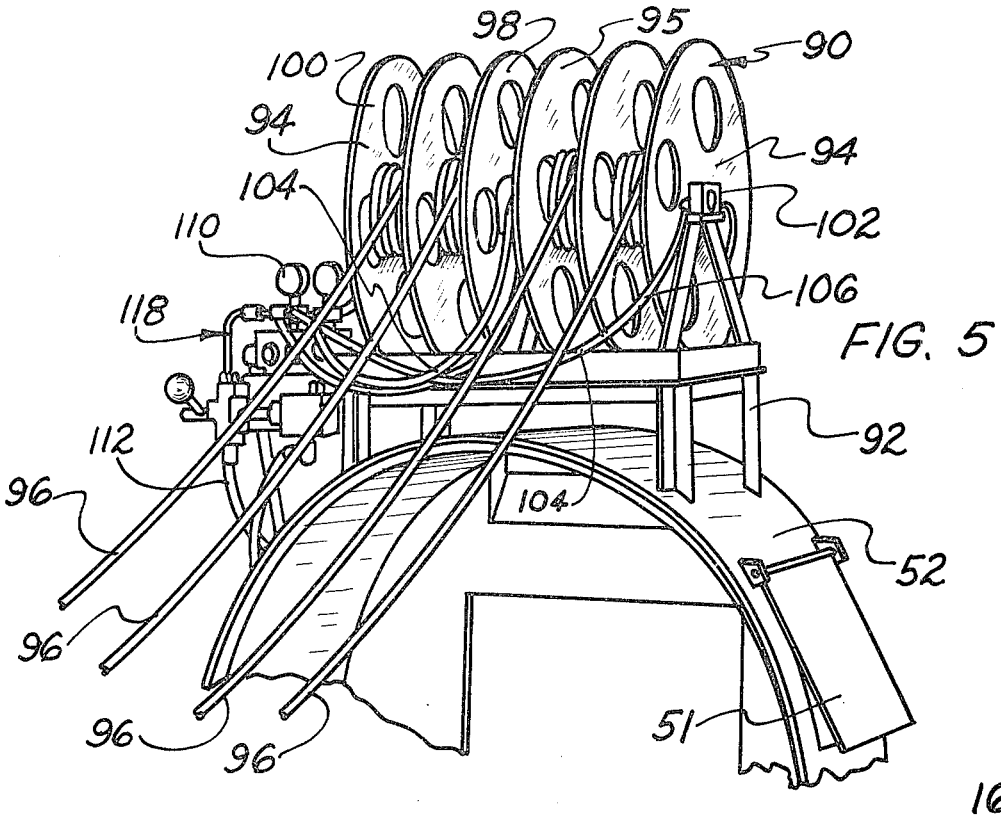
FIG. 5 is a partial front perspective view of a control system for the remotely controlled apparatus of FIGS. 1 and 2.

With continued reference to FIG. 3, each wedging apparatus is preferably provided with a removable housing 118 to protect the mechanism from drillings which continually progress rearwardly from rock pit 160 and between the radial legs 87 to the auger blades which continually move the drillings rearwardly and outwardly through the discharge opening 51 in pusher ring 52, the latter being seen in FIG. 5.

Referring next to FIG. 5, the previously described fluid supply lines 96 are of flexible construction and normally stored on a reel assembly indicated generally at 90 which assembly includes the four separate spools 94, 95, 98 and 100 each of which is adapted to feed out and roll up a respective flexible hydraulic line 96 leading to a respective power cylinder 122.

Figure 6:
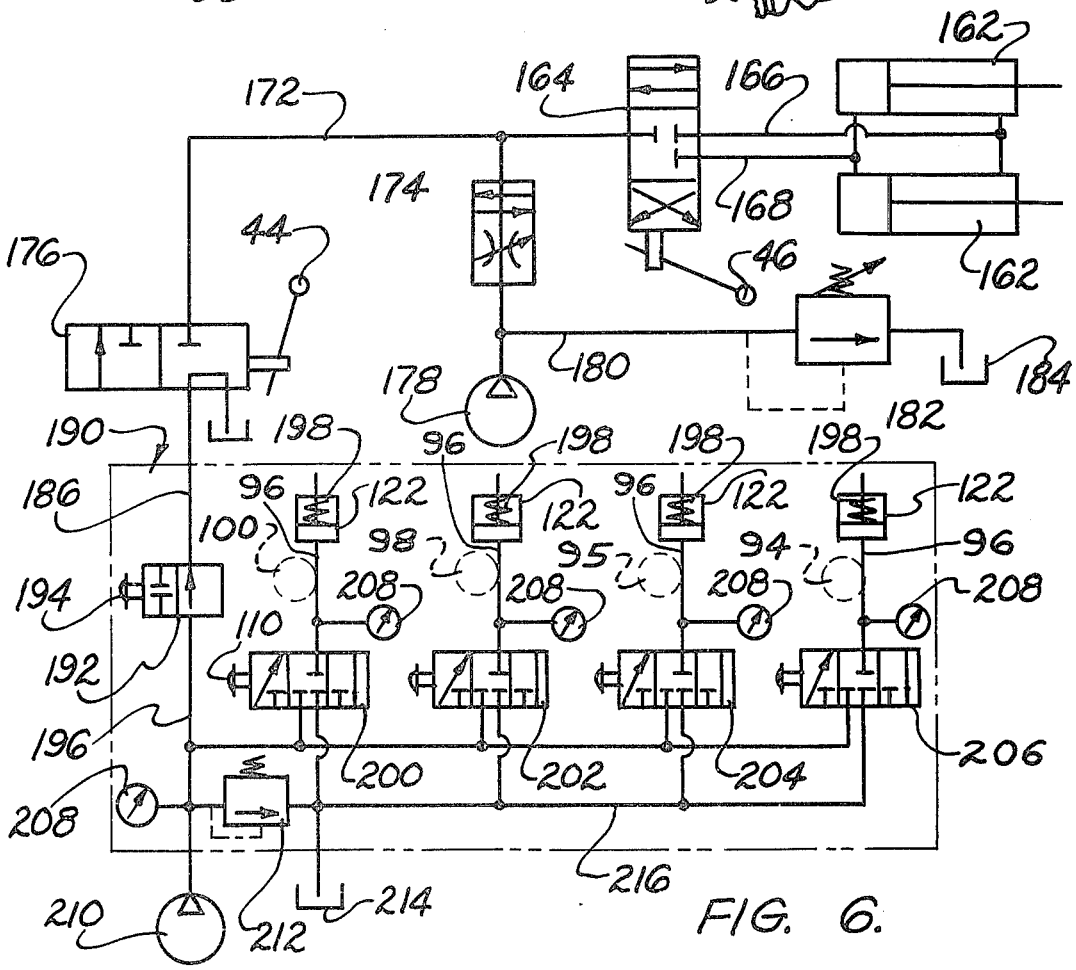
FIG. 6 is a diagrammatic view of a hydraulic control system for the control system of the embodiment of FIGS. 1 and 2.

With continued reference to FIG. 5, reel assembly 90 further includes a central manifold means 102 adapted to feed the flexible lines 96 with the manifold means being supplied with pressurized oil by respective conduit 104 each of which includes a respective control valve 200, 202, 204 and 206 as shown in FIG. 6.

With continued reference to FIG. 5, the reel assembly and a related control apparatus indicated generally 118 are shown mounted on a control base 92, which is preferably located on the top of pusher ring 52 at the operator's station, but it can be located at any remote location without departing from the spirit of the present invention.

Reference is next made to FIG. 6 which diagrammatically illustrates the hydraulic circuit for the machine of the present invention. The pushing cylinder portion of the circiut, during high speed operation, includes a fixed displacement pump 210 adapted to supply pressurized hydraulic fluid to the previously mentioned pushing cylinders 162 via line 196, diverter valve 192, line 186, a three-way "High-Low" speed control valve 176, line 172, and a four-way closed center control valve 164, the latter being connected to the pushing cylinders 162 via lines 166 and 168.

Directional control valve 164 includes a manual actuator 46 which can be shifted by the operator so as to either pressurize the base chambers of pushing cylinders 162 via line 168 or the rod ends of such pushing cylinders 162 via line 166. Hence it will be understood that valve 164 is used to either extend or retract the previously mentioned carriage 24 as well as pusher ring 52 so as to push the casing sections into the drilled holes.

The pushing cylinder portion of the circuit further includes a second fixed displacement pump 178 for low speed operation which is provided with an adjustable pressure relief valve 182 for establishing the maximum pressure delivered by pump 178, as well as a flow control valve 174. It will now be understood that the pushing cylinder portion of the circuit is adapted for both low and high speed operation by the availability of the second hydraulic pump 210 and the fluid flow from this pump can be added to the fluid flow delivered by the previously mentioned pump 178 by opening a three-way "High-Low" speed control valve 176 when the operator actuates the manual actuator 44.

With continued reference to the circuit of FIG. 6, hydraulic pump 210 serves the added functions of powering and controlling the steering head 80 by supplying pressurized fluid to the previously mentioned power cylinders 122 which operate the wedging elements 126. This portion of the circuit includes a pressure relief valve 212 adapted to by-pass excess fluid back to reservoir 214 with pressurized fluid being delivered via line 196 to normally closed wedge control valves 200, 202, 204 and 206 each of which is adapted to selectively pressurize the base end of a respective power cylinder 122, with each of said cylinders being adapted to operate a respective wedging element 126 in the manner previously described.

As seen in FIG. 6, when it is desired to operate the steering head portion of the circuit a shut-off valve 192 is shifted by the operator, by actuating lever 194 to its closed position whereby pressurized fluid is made available to the four wedge control valves with each of the said valves including a manual operator 110.

It should be further mentioned that when it is desired to operate the pushing cylinders 162 at high speeds then valve 192 is maintained open and the previously mentioned "High-Low" speed control valve 196 is opened so as to deliver the additional fluid capacity from pump 210 into the pushing cylinder portion of the circuit. When it is desired to operate the pushing cylinders 162 at low speed operation, then actuator 44 is used to close "High-Low" speed control valve 176 whereby only the volumetric flow from the other pump 178 is delivered to the pushing cylinders 162.

With continued reference to FIG. 6, it should be mentioned that the actuators for the wedging elements 126 include the return springs 198 thereby eliminating the need for a double acting power cylinder construction for wedge actuating cylinders 122.

It should further be mentioned that in the preferred embodiment, the wedging means 82 are preferably located at 90° intervals with their positions being at the right side, left side, top and bottom. Hence by pressurizing the left wedging cylinder and depressurizing the right wedging cylinder then the biasing effect of left wedge 126 will direct the rock head 150 and the lead casing section to the right. The converse will of course be true when the right wedge actuating cylinder 122 is pressurized and the left wedging cylinder is relieved. Moreover, when the upper wedging element is pressurized by its respective cylinder, with the lower wedging element being relieved, then the rock head and front casing section will be wedged downwardly, with the opposite being true when the lower wedging cylinder 122 is pressurized and the pressure in the upper wedging cylinder is relieved. Moreover, when the upper wedging element is pressurized by its respective cylinder, with the lower wedging element being relieved, then the rock head and front casing section will be wedged downwardly, with the opposite being true when the lower wedging cylinder 122 is pressurized and the pressure in the upper wedging cylinder is relieved.

Figure 4:
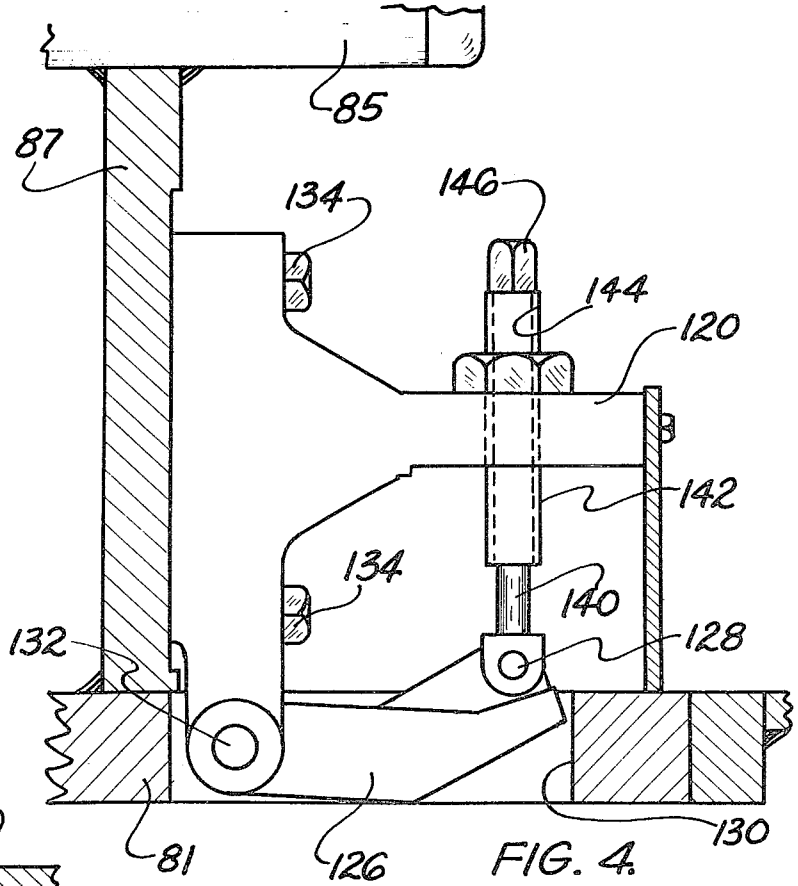
FIG. 4 is a partial side elevational view showing a modified manualy operated wedging means for the machine of FIG. 1.

Reference is next made to FIG. 4 which illustrates a modified manually controllable steering apparatus which includes elements identical to those previously described in connection with FIG. 3, with the hydraulic embodiment of like elements being identified by identical numerals. Such manual embodiment does not require hydraulic circuit and merely includes male and female screw elements 142 and 144, with the latter being mounted on bracket 120. Hence when the male element is rotated by application of a wrench to its head 146 then wedging element 126 is either extended or retracted depending on the direction of rotation. This manual steering apparatus, though less convenient, is operable where cost is a factor, and with larger casing sections where it is possible for the operator to remove the auger and crawl into the casing sections up to the forward end where the male screw members 146 can be actuated with a wrench as required to achieve the desired steering control.

While the form of embodiment of the present invention as herein disclosed constitutes a preferred form, it is to be understood that other forms might be adopted.

What is claimed is:

1. In an earth boring apparatus of the type that forms horizontal holes and pushes sections of casing into said holes, the combination of casing means comprising a lead casing section provided with a plurality of side openings; bearing means mounted in said lead casing section; a rock head mounting shaft journaled in said bearing means; a rock drilling head mounted on the forward end of said mounting shaft; a wedging means radially moveably mounted at each of said side openings and extendable outwardly therefrom; a cylinder mounting bracket within said lead casing section adjacent said bearing means at each of said side openings; a fluid actuated cylinder on said mounting bracket and connected to a respective one of said wedging means, the direction of movement of said cylinder being generally perpendicular to the axis of rotation of said rock drilling head; conduit means connecting each of said cylinders with a source of pressurized fluid; control valve means for each of said fluid actuated cylinders for selectively pressurizing said cylinders to extend said wedging means, said control valve means being manually actuated at a control station remote from said cylinders.

2. The apparatus defined in claim 1 wherein said wedging means comprises separate wedging apparatus spaced circumferentially around said lead casing section.

3. The apparatus defined in claim 1 wherein said wedging means comprises separate wedging apparatus spaced circumferentially around said lead casing section; and a separate controller for each of said wedging apparatus.

4. In an earth boring apparatus of the type that forms horizontal holes and pushes sections of casing into said holes, the combination of casing means comprising a lead casing section; bearing means mounted in said lead casing section and including radially extending bearing mounting legs supported by said lead casing section; a rock head mounting shaft journaled in said bearing means; a rock drilling head mounted on the forward end of said mounting shaft; wedging means on said lead casing section and including a moveably mounted wedging element laterally extendable and retractable relative to said casing section; a fluid actuated cylinder mounted on one of said radially extending legs and connected to one of said wedging means, the axis of extension and retraction of said cylinder being generally aligned with said bearing mounting leg.

5. The earth boring apparatus of claim 4 that includes a storage spool means at said remote station; flexible conduit means connecting said fluid motor with said source, said conduit means being extendably stored on said spool means.

6. In an earth boring apparatus of the type that forms horizontal holes and pushes sections of casing into said holes, the combination of casing means comprising a lead casing section; bearing means mounted in said lead casing section and including radially extending bearing mounting legs supported by said lead casing section; a rock head mounting shaft journaled in said bearing means; a rock drilling head mounted on the forward end of said mounting shaft; wedging means on said lead casing section and including a moveably mounted wedging element laterally extendable and retractable relative to said casing section; an actuating screw mounting bracket within said lead casing section adjacent said bearing means at each of said side openings; and an actuating screw on said screw mounting bracket and including an outer end connected to said wedging element, the axis of rotation of said screw being generally normal to the axis of rotation of said rock drilling head.

* * * * *